US007686485B1

(12) United States Patent
Pever et al.

(10) Patent No.: US 7,686,485 B1
(45) Date of Patent: Mar. 30, 2010

(54) OUTDOOR DECK LIGHTING SYSTEM

(75) Inventors: Steve E. Pever, Bellefontaine, OH (US); Timothy C. Rothwell, Dublin, OH (US)

(73) Assignee: The Crane Group Companies Limited, Columbus, OH (US)

( * ) Notice: Subject to any disclaimer, the term of this patent is extended or adjusted under 35 U.S.C. 154(b) by 80 days.

(21) Appl. No.: 12/049,938

(22) Filed: Mar. 17, 2008

(51) Int. Cl.
*F21S 13/10* (2006.01)

(52) U.S. Cl. ..... 362/431; 362/153.1; 362/152

(58) Field of Classification Search ..... 362/145, 362/146, 152, 153, 153.1, 362, 373, 431
See application file for complete search history.

(56) References Cited

U.S. PATENT DOCUMENTS

| | | | | | |
|---|---|---|---|---|---|
| 2,657,367 | A | | 10/1953 | Brooks | |
| 2,721,255 | A | | 10/1955 | Lanmon | |
| 2,742,549 | A | | 4/1956 | Peters | |
| 3,222,509 | A | * | 12/1965 | Thedford | 362/152 |
| 3,448,257 | A | | 6/1969 | Sackett, Jr. | |
| 4,080,034 | A | | 3/1978 | Werner | |
| 4,270,830 | A | | 6/1981 | Brenner | |
| 4,638,411 | A | * | 1/1987 | Trainor | 362/145 |
| 4,648,675 | A | | 3/1987 | Gaines | |
| 4,888,669 | A | | 12/1989 | Hanson | |
| 4,951,184 | A | | 8/1990 | Makurof | |
| 5,001,611 | A | | 3/1991 | Beachy et al. | |
| 5,007,855 | A | | 4/1991 | O'Brien et al. | |
| 5,055,987 | A | * | 10/1991 | Ellson et al. | 362/431 |
| 5,057,979 | A | | 10/1991 | Carson et al. | |
| 5,429,530 | A | | 7/1995 | Zander et al. | |
| 5,493,825 | A | | 2/1996 | Gaston | |
| 5,642,934 | A | | 7/1997 | Haddad | |
| 5,658,071 | A | | 8/1997 | Kelpin | |
| 5,701,236 | A | | 12/1997 | Viviano | |
| 6,004,154 | A | | 12/1999 | O'Brien | |
| 6,425,676 | B1 | | 7/2002 | Lyons | |
| 6,467,928 | B2 | | 10/2002 | Crelin | |
| 6,585,398 | B1 | | 7/2003 | Haddad | |
| 6,742,748 | B1 | | 6/2004 | Gretz | |
| 6,779,907 | B2 | | 8/2004 | Beadle | |
| 6,941,715 | B2 | | 9/2005 | Potter | |
| 7,021,786 | B1 | | 4/2006 | Sandor, Sr. | |
| 7,036,960 | B1 | | 5/2006 | Gretz | |
| 2002/0191391 | A1 | | 12/2002 | Van Etten | |
| 2004/0095772 | A1 | | 5/2004 | Hoover et al. | |
| 2005/0128758 | A1 | | 6/2005 | Brick | |
| 2005/0146864 | A1 | * | 7/2005 | Haddad et al. | 362/145 |

OTHER PUBLICATIONS

Elights.com, Progress P8651 Quick Connector Landscape Accessory, printed May 8, 2008, 1 page, http://www.elights.com/p8651.html.

Elights.com, Kichler 15509 Quic Disc Low Voltage Cable Connector, printed May 8, 2008, 1 page, http://www.elights.com/quiccon.html.

Hadco, Connector (LVC3), printed May 8, 2008, 1 page, http://www.hadco.com/hadco/Public/ProductDetail.aspx?pid=1149&Id=16.

Hadco, Connector (LVC4), printed May 8, 2008, 1 page, http://www.hadco.com/hadco/Public/ProductDetail.aspx?pid=1150&Id=16.

* cited by examiner

*Primary Examiner*—Y My Quach Lee
(74) *Attorney, Agent, or Firm*—Standley Law Group LLP

(57) ABSTRACT

A lighting assembly designed to fit within a rail post. The lamp post assembly focuses light toward the ground to prevent sending light into the night sky or into the eyes of users. The lamp assembly fits within a post to provide an aesthetically pleasing appearance. The lamp assembly can be installed in existing post configurations or installed with a new post. The lamp assembly also hides the wiring necessary for the lamp from view, thus providing a more aesthetically pleasing appearance.

20 Claims, 4 Drawing Sheets

OUTDOOR DECK LIGHTING SYSTEM

BACKGROUND AND SUMMARY OF THE INVENTION

Embodiments of the present invention relate generally to lighting systems for outdoor deck areas, for lighting purposes as well as decorative purposes, and more particularly to a post light assembly which is integrated into a deck post.

Outdoor deck areas are very popular as they add to the beauty of the home as well as provide a functional place to enjoy the outdoors. However, many decks do not have a sufficient lighting such that they can be enjoyed during the night time as well as the day time. Furthermore, the decks that currently employ lighting systems must run the wiring on the surface of the posts, railings, and deck surface, providing a look that is not aesthetically pleasing. Occasionally the wires are hidden by a conduit, but these materials are still not aesthetically pleasing. Also, post lights are typically separate assemblies which attach to the top of existing posts.

Exemplary embodiments of the present invention provide a lighting system for an outdoor deck area that provides sufficient lighting while at the same time adding to the aesthetic value of the area. Therefore, embodiments of the present invention may substantially hide the wires from view and incorporate the light housings into the deck components. More specifically, embodiments of the present invention may integrate the post light assembly materials into the existing post structure, thus providing a more seamless look and greater aesthetic appeal.

Embodiments of the present invention provide a lighting system that may be built specifically for the deck including the deck surface, railings, and posts to provide a total deck experience. In other words, the deck does not need to be torn up and rearranged to put in the lighting system; the deck may be manufactured to allow the easy installation of the lighting system.

The lighting system does not have to be tailor-made for every home, but can be manufactured at a high production rate and can be installed at existing homes or businesses. Also, the embodiments do not need to be installed by a specialized carpenter, but instead can be installed by the homeowner. In this way, cost is minimized.

Also, current post lights allow light to shine in an upward direction, thus wasting lighting efficiency by sending light into the night sky as well as into the eyesight of deck users. Embodiments of the present invention may focus light toward the deck itself, thus making more efficient use of the light lumens and preventing light from shining into the eyes of deck users.

In addition to the novel features and advantages mentioned above, other benefits will be readily apparent from the following descriptions of the drawings and exemplary embodiments.

DETAILED DESCRIPTION OF EXEMPLARY EMBODIMENT(S)

Exemplary embodiments of the present invention are directed to the figures described herein.

Figure 1A:
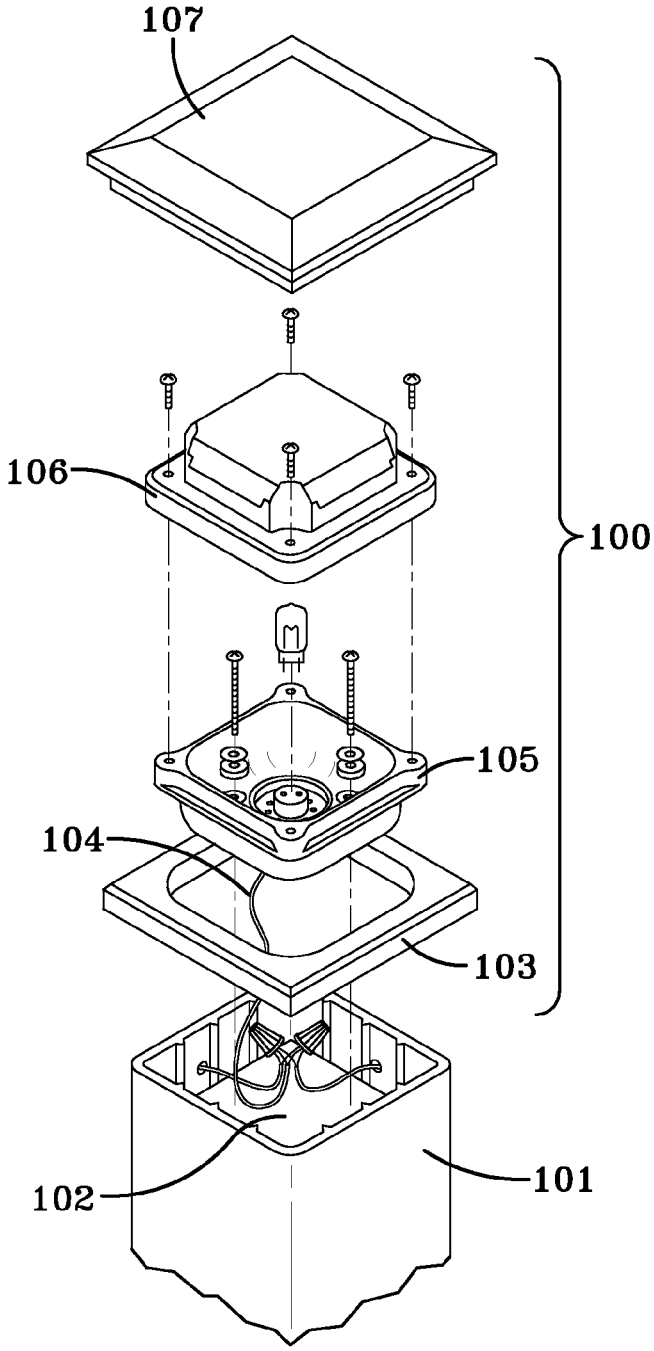
FIG. 1A is an exploded view of an exemplary embodiment of the deck post light assembly and FIG. 1B is an exploded view of an exemplary embodiment of the placement of a spring clip within the post cap.
Figure 1B:
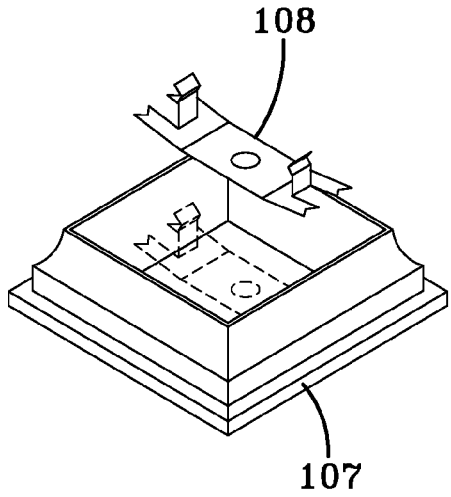

FIG. 1A is an exploded view of an exemplary embodiment of the post light assembly 100 and FIG. 1B shows the placement of a spring clip 108 within the post cap 107. In FIG. 1A, the post cover 101 fits over the post 102. The deck, post 102, and post cover 101 may be made from well known materials such as, but not limited to, wood, plastic, wood composites, and/or metal. The gap between the post cover 101 and the post 102 may allow wiring 104 to pass from underneath the deck surface to the top of the post 102 without being seen by a deck user. Wiring 104 may also enter the top of the post 102 by passing through a hole in the post cover 101. This technique may be used if the wiring 104 is traveling along the length of a rail rather than coming from below the deck surface.

The lens 103 sits on top of the post cover 101. In one exemplary embodiment, the lens 103 may be made of a translucent material to allow light to pass through. The lamp bottom housing assembly 105 fits within the lens 103 and is attached to the post 102. The lamp bottom housing assembly 105 may also be made of a translucent material to allow light to pass through. The lamp top housing assembly 106 attaches to the lamp bottom housing assembly 105 to protect the lamp components from environmental damage as well as protect other assembly parts from damage due to the heat of the lamp. The lamp top housing assembly 106 preferably contains a material or fixture that will reflect the light off of the lamp top housing assembly 106 and allow it to pass through the lamp bottom housing assembly 105 and the lens 103. Using an opaque white plastic material for the lamp top housing assembly 106 is one way to reflect the light downward, although any reflective method will suffice.

The spring clip 108 may be used to attach the post cap 107 to the lamp top housing assembly 106. This method of attachment provides a "fastener free" look which is also aesthetically pleasing. The spring clip 108 is first attached into the post cap 107 and then the post cap 107 and spring clip 108 are attached onto the lamp top housing assembly 106. The post cap 107 may be made of the same material and finish as the post cover 101. In an exemplary embodiment, this material may be an opaque color, which can match throughout the deck railings, stairs, and surface decking. Matching all materials in this manner provides a seamless and aesthetically pleasing deck appearance.

Figure 2:
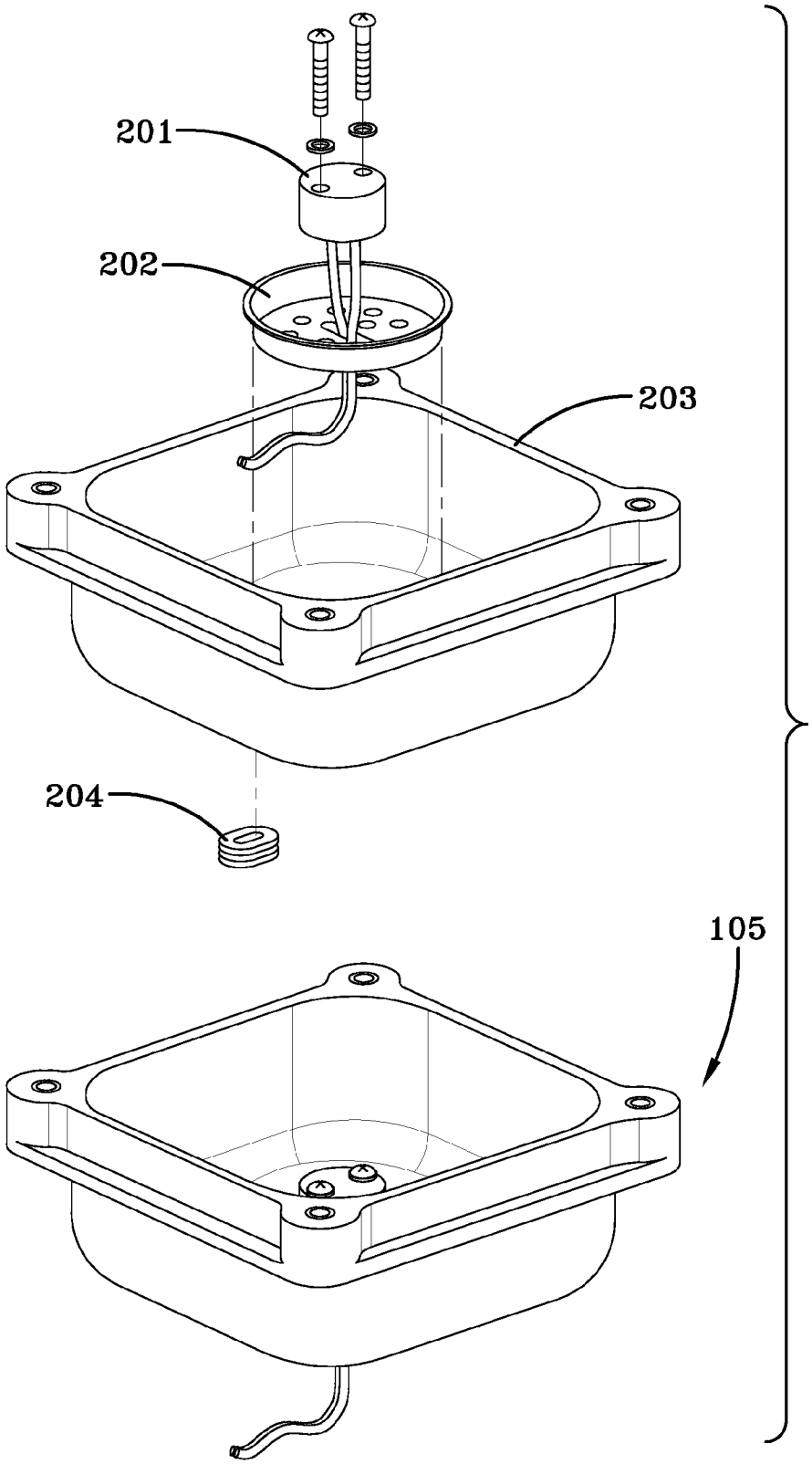
FIG. 2 is an exploded view of the lamp bottom housing assembly.

FIG. 2 is an exploded view of the lamp bottom housing assembly 105. A grommet 204 is used to allow the passage of wires through the lamp bottom housing 203 while maintaining a protective seal around the lamp assembly. The lamp socket 201 is attached to the lamp socket bracket 202 which is in turn attached to the lamp bottom housing 203. The lamp socket bracket 202 has several holes to facilitate the flow of air in order to cool the lamp socket 201.

Figure 3A:
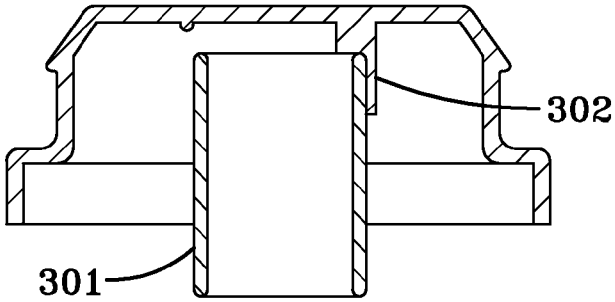
FIGS. 3A through 3C are cross section, bottom perspective, and top perspective views of an exemplary embodiment of the lamp top housing assembly respectively.
Figure 3B:
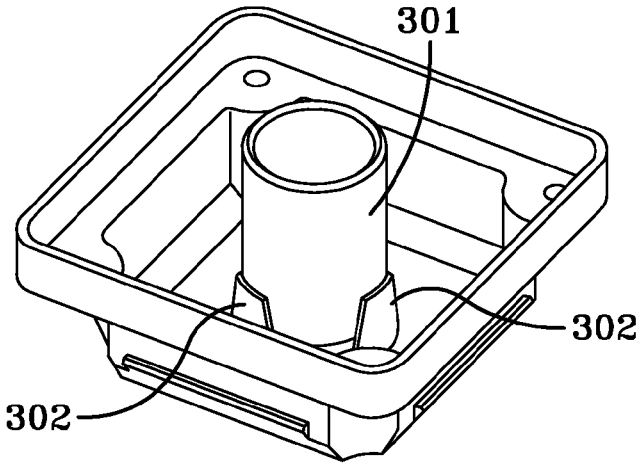
Figure 3C:
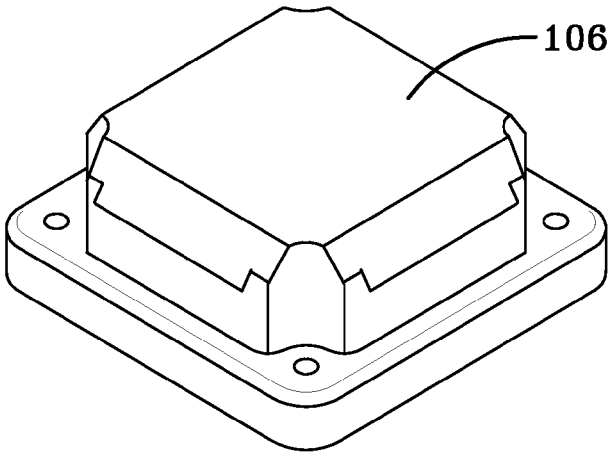

FIG. 3A is a cross section, view of the lamp top housing assembly 106. The lamp cylinder 301 is used to create a seal around the lamp assembly when the lamp top housing assembly 106 is attached to the lamp bottom housing assembly 105 (not shown in this figure). The lamp cylinder 301 is attached by applying adhesive between tabs 302 and the lamp cylinder 301. One appropriate type of adhesive would be high temperature silicone, although many other adhesives will suffice. The lamp cylinder 301 further protects the lamp assembly from environmental damage as well as protects other post lamp components from damage due to the heat generated by the lamp assembly. FIG. 3B shows a bottom perspective view of one embodiment of the lamp top housing assembly 106. FIG. 3C shows a to perspective view of one embodiment of the lamp top housing assembly 106.

Figure 4A:
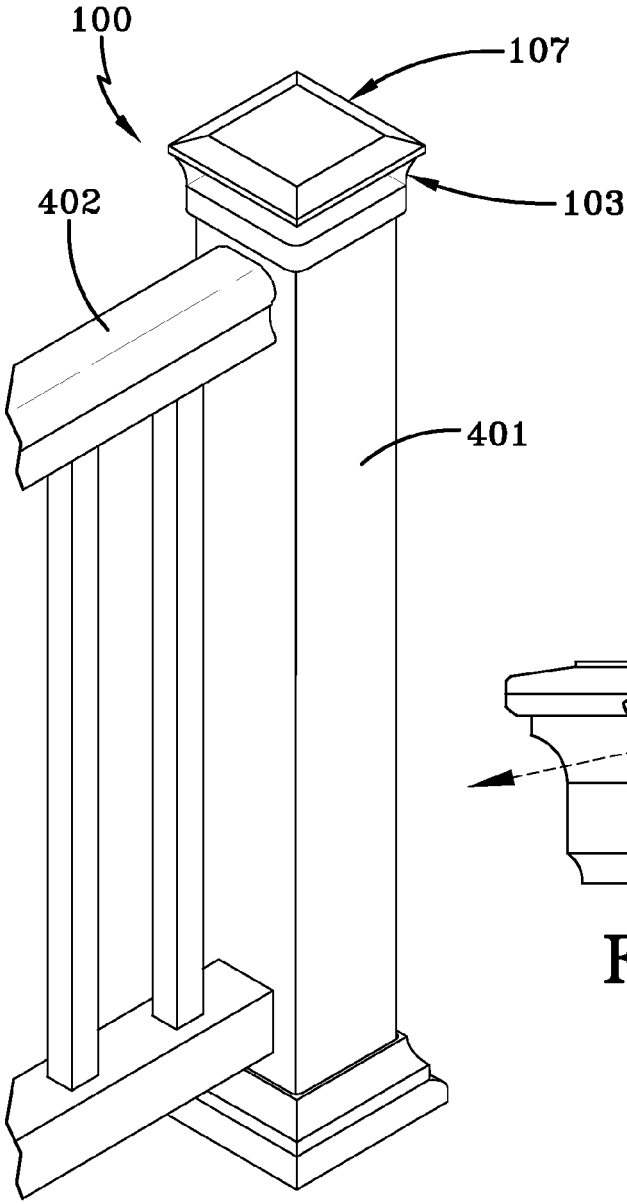
FIG. 4A is an illustration of an exemplary embodiment of the post cap light assembly when fully assembled with a post and railing and FIG. 4B is a side view showing an optional light reflector.
Figure 4B:
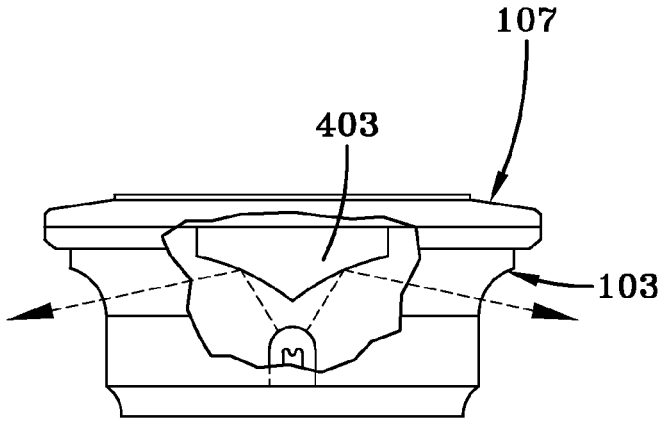

FIG. 4A is an illustration of an exemplary embodiment of the post cap light assembly 100 when fully assembled with a post 401 and railing 402. FIG. 4B shows a light reflector 403 which can be placed above the lamp assembly to further direct the light away from the post cap 107 and out of the lens 103.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A post light assembly comprising:
a vertical post;
a post cover covering said post and extending above said post;
a translucent lens attached to the top of said post cover;
a bottom housing adapted to fit within said lens;
a lamp assembly attached to said bottom housing;
a top housing attached to said bottom housing, enclosing said lamp assembly;
a post cap attached to said top housing;
wherein said post, post cover, lens, and post cap define a cavity; and
wherein said bottom housing, top housing, and lamp assembly are within said cavity.

2. The assembly of claim 1, wherein said bottom housing is translucent.

3. The assembly of claim 1, wherein a spring clip attaches said post cap to said top housing.

4. The assembly of claim 1, further comprising a wire passing between said post and said post cover, through the bottom housing, and connecting to said lamp assembly.

5. The assembly of claim 4, wherein a grommet is used to seal an opening in said bottom housing where said wire enters said bottom housing.

6. The assembly of claim 1, further comprising:
a hole in said post cover;
a wire passing through said hole, continuing through the bottom housing and connecting to said lamp assembly.

7. The assembly of claim 6, wherein a grommet is used to seal an opening in said bottom housing where said wire enters said bottom housing.

8. The assembly of claim 1, wherein said bottom housing and said top housing are symmetrical such that multiple alignments may be used when attaching said bottom housing to said top housing.

9. The assembly of claim 1, wherein said post contains a channel through which a wire to said lamp assembly is ran.

10. The assembly of claim 1, wherein said lens is frosted, tinted, or etched.

11. The assembly of claim 1, further comprising:
a glass tube attached to said top housing;
wherein said glass tube surrounds said lamp assembly when said top housing is attached to said bottom housing.

12. The assembly of claim 1, wherein said bottom housing and said top housing allow air flow to said lamp assembly.

13. The assembly of claim 1, wherein said lamp assembly comprises:
a lamp socket bracket;
a lamp socket attached to said lamp socket bracket; and
wherein said lamp socket bracket contains voids to facilitate the cooling of said lamp socket.

14. The assembly of claim 1, further comprising a light reflector attached to the side of said top housing that faces the lamp assembly.

15. A post light assembly comprising:
a vertical post;
a post cover covering said post and extending above said post;
a translucent lens attached to the top of said post cover;
a translucent bottom housing adapted to fit within said lens;
a lamp assembly attached to said bottom housing;
a top housing attached to said bottom housing, enclosing said lamp assembly;
a spring clip attached to said top housing;
a post cap attached to said spring clip;
wherein said post, post cover, lens, and post cap define a cavity; and
wherein said bottom housing, top housing, and lamp assembly are within said cavity.

16. The assembly of claim 15, further comprising a wire passing between said post and said post cover, through the bottom housing, and connecting to said lamp assembly.

17. The assembly of claim 16, wherein a grommet is used to seal an opening in said bottom housing where said wire enters said bottom housing.

18. A post light assembly comprising:
a vertical post;
a post cover covering said post and extending above said post;
a translucent lens attached to the top of said post cover;
a translucent bottom housing adapted to fit within said lens;
a lamp assembly attached to said bottom housing, comprising
a socket,
a socket bracket attached to said socket and to said bottom housing, said socket bracket comprising several voids to facilitate the cooling of said socket;
a top housing assembly connected to said bottom housing, said top housing assembly comprising:
a top housing,
a glass cylinder,
a reflective device facing said lamp assembly, and
wherein said glass cylinder encloses said lamp assembly when said top housing assembly is connected to said bottom housing;
a spring clip attached to said top housing;
a post cap attached to said spring clip;
wherein said post, post cover, lens, and post cap define a cavity; and wherein said bottom housing, top housing assembly, and lamp assembly are within said cavity.

19. The assembly of claim 18, further comprising a wire passing between said post and said post cover, through the bottom housing, and connecting to said lamp assembly.

20. The assembly of claim 19, wherein a grommet is used to seal an opening in said bottom housing where said wire enters said bottom housing.

* * * * *

UNITED STATES PATENT AND TRADEMARK OFFICE

CERTIFICATE OF CORRECTION

PATENT NO. : 7,686,485 B1
APPLICATION NO. : 12/049938
DATED : March 30, 2010
INVENTOR(S) : Pever et al.

It is certified that error appears in the above-identified patent and that said Letters Patent is hereby corrected as shown below:

In column 2, line 62, please delete "section, view" and insert -- section view --.

In column 3, line 8, please delete "to" and insert -- top --.

Signed and Sealed this

Fourth Day of May, 2010

David J. Kappos

David J. Kappos
*Director of the United States Patent and Trademark Office*